United States Patent [19]

Roubal et al.

[11] 4,039,714

[45] Aug. 2, 1977

[54] PRETREATMENT OF PLASTIC MATERIALS FOR METAL PLATING

[75] Inventors: Jiri Roubal; Joachim Korpiun, both of Geislingen, Steige, Germany

[73] Assignee: Dr. -Ing. Max Schloetter, Geislingen, Steige, Germany

[21] Appl. No.: 478,276

[22] Filed: June 11, 1974

Related U.S. Application Data

[63] Continuation of Ser. No. 256,768, May 25, 1972, abandoned.

[30] Foreign Application Priority Data

May 28, 1971 Germany ..... 2126781

[51] Int. Cl. ..... B05d 3/04

[52] U.S. Cl. ..... 428/336; 427/307

[58] Field of Search ..... 117/47 A, 160 R, 130 E; 427/307, 322; 428/336

[56] References Cited

U.S. PATENT DOCUMENTS

| | | | |
|---|---|---|---|
| 2,937,066 | 5/1960 | Walles | 8/4 |
| 3,033,703 | 5/1962 | Schneble | 117/47 A |
| 3,442,683 | 5/1969 | Lenoble | 117/160 R |
| 3,466,229 | 9/1969 | Whitacre et al. | 427/307 |
| 3,475,194 | 10/1969 | Samour | 427/322 |
| 3,578,484 | 5/1972 | Walles | 117/47 A |
| 3,607,350 | 9/1971 | Rathsack | 117/47 A |
| 3,682,786 | 8/1972 | Brown | 117/47 A |
| 3,684,554 | 8/1972 | Donald et al. | 117/47 A |
| 3,740,252 | 6/1973 | Chaikin | 427/307 |
| 3,940,520 | 2/1976 | Dixon et al. | 427/322 |

*Primary Examiner*—Bernard D. Pianalto
*Attorney, Agent, or Firm*—Bacon & Thomas

[57] ABSTRACT

Plastics and articles made therefrom are metal plated by conditioning their surface by a treatment with sulfur trioxide vapor or a sulfur trioxide containing atmosphere. The thus conditioned plastics or plastic articles are then metal plated, if required, after sensibilization, nucleation or activation, and treatment with a reducing solution. Metal plating is effected by chemical deposition of the metal or by electroplating. The resulting metal layer is reenforced, if required, also by chemical plating or electroplating. The resulting metal coating has a surprisingly high adhesive strength.

37 Claims, 4 Drawing Figures

PRETREATMENT OF PLASTIC MATERIALS FOR METAL PLATING

This is a continuation of application Ser. No. 256,768, filed May 25, 1972 and now abandoned.

BACKGROUND OF THE INVENTION

1. Field of the Invention

The present invention relates to the pretreatment of plastic materials and articles which are to be metal plated and more particularly to an improvement in the process of surface conditioning such plastic materials and articles so as to provide them with a conducting base or priming coating which permits metal plating of said materials and articles, and products produced thereby.

2. Description of the Prior Art

In recent years electroplating as well as metallic coating of plastics has become of ever increasing importance. In order to provide plastics with firmly bonded metal coatings, the plastic material must be subjected to a pretreatment whereby it is coated with a conductive base coating. Heretofore, such a base coating was produced by carrying out the following process steps:

1. The surface of the plastic material was subjected to a chemical treatment, usually with chromium trioxide containing solutions, which changes the properties of the surface of the plastic material so as to create optimum conditions for the nucleation with and deposition thereon of noble metal ions and to cause satisfactory adherence of the chemically deposited metal layer.

2. The thus pretreated plastic surface is treated with a solution for reducing the chromium trioxide ions.

3. The surface is then activated, usually by immersing it into a solution containing a noble metal ion, such as palladium, silver, gold.

4. The surface is then immersed into a solution of a reducing agent in which the adsorbed noble metal ions are reduced to noble metal nucloi.

When pretreating the plastic surface in the described manner, it is possible to deposit thereon a firmly bonded, continuous metal layer by placing the thus pretreated plastic material into solutions for the electroless metal deposition.

Another way of depositing a metal layer upon the surface of plastic materials or articles consists in 1*a.* chemically treating the plastic surface as described hereinabove under (1), 2*a.* treating the thus pretreated plastic surface as described hereinabove under (2), 3*a.* sensitizing the plastic surface by immersing it into an acidified solution of stannous chloride, and 4*a.* producing noble metal nuclei thereon as described hereinabove under (3).

When proceeding in this manner step (4) as given hereinabove can be omitted.

Usually a mixture of chromium trioxide, sulfuric acid, and water or, respectively, of chromium trioxide, sulfuric acid, phosphoric acid, and water is used in step (1). The composition of such mixtures depends upon the type of plastic to be treated. Mixtures of this type have mainly been used for the pretreatment of ABS (acrylonitrile-butadiene-styrene) plastics and of polypropylene and similar plastics. Duration and temperature of said treatment are dependent not only on the kind of plastic to be treated, but also, when the same kind of plastic is used, on the type supplied by the different manufacturers and, in some instances, on the conditions under which the plastics were manufactured as well as on the geometrical shape of the processed, machined, or molded plastic. In each instance optimum duration and temperature of the treatment are to be predetermined empirically.

The amounts of the components in the chromium trioxide-containing solutions must also be within a predetermined, rather narrow range of concentration. Only deviations of a few percent from the optimum amounts are permissible because otherwise, on subsequent chemical deposition of the metal, the plastic surface is not completely coated by the metal or, respectively, the entire coating does not possess sufficient adhesive strength.

Analytical supervision and dosing of the chemicals consumed during the treatment requires continual control of the concentration of the various components and thus complicates considerably the operating conditions. Such solutions have the further disadvantage that they become useless as soon as they contain a certain content of degradation products of the plastic and of trivalent chromium compounds. To eliminate the used pretreatment solution, it is necessary to reduce the hexavalent chromium compounds whereafter neutralization is required. Thereby, large amounts of highly voluminous chromium hydroxide are formed, the removal of which encumbers very considerably the detoxifying plant. Thus to detoxify the chromium-containing pretreatment baths, requires very considerable expenditures and technical apparatus and plants.

Processes are known to treat the surfaces of plastics with sulfonating agents. Thus antistatic properties are imparted to polystyrene by dipping it into a weak solution of chloro sulfonic acid in an aliphatic hydrocarbon for a short period of time, namely for less than one minute. Such a solution attacks the surface of the polystyrene and adds reactive groups to the polystyrene chain. After rinsing and drying the treated plastic articles, they are dipped into another solution which causes formation of metal salts by ion exchange of the hydrogen atoms of the reactive groups by metal ions. The resulting rinsed and dried articles have imparted thereto satisfactory antistatic properties whereby the transparency of the polystyrene is not affected. This process has been found effective with pure polystyrene only and not with its copolymers and terpolymers, and also not with colored polystyrene. The dilute chlorosulfonic acid solutions in aliphatic hydrocarbons lose their effectiveness in a relatively short period of time, for instance, in up to seven hours.

In another known process polyethylene films and other shaped polyethylene articles are provided with a well adhering and firmly anchored integral coating of a resinous tripolymer of vinylidene chloride, acrylonitrile, and a functionally basic ethenoid monomer such as vinyl pyridine, 2-methyl-5-vinyl pyridine, 2-morpholino ethyl acrylate, N-dimethylamino ethyl acrylate, by first sulfonating surface of the polyethylene article and subsequently applying a layer of the functionally basic resinous tripolymer to the sulfonated surface. Useful sulfonating reagents are concentrated, at least 98%, sulfuric acid, oleum, anhydrous solutions of oleum and up to about 10% by weight of dissolved sulfur trioxide, or sulfur trioxide vapors. By such a treatment the surface of polyethylene is conditioned so that the layer of the resinous tripolymer subsequently applied to the sulfonated surface is firmly bonded to the polyethylene surface.

It is also known that treatment of most plastics with concentrated sulfuric acid, oleum, or chloro sulfonic acid results in a very considerable roughening and even in decomposition and carbonization or charring of their surfaces.

It is furthermore known to provide polystyrene with a metallic layer by first treating its surface with a solution of sulfur trioxide in a halogenated hydrocarbon and trimethyl phosphate. Such a treatment results in a softening and conditioning of the polystyrene surface so that the adhesive strength of the metal layer applied thereto by electroless plating followed, if required, by electroplating, is insufficient. The conditioning solution has the disadvantage that it is quite unstable because, on standing, decomposition products are formed very soon by the action of sulfur trioxide upon the solvent. The highly poisonous phosgene is one of such decomposition products.

Another disadvantage of this process is to be seen in the fact that the sulfuric acid produced by reaction of sulfur trioxide with the plastic and by the action of the humidity of the atmosphere separates from the conditioning solution in the form of small droplets which settle on the surface of the plastic and thus render impossible uniform conditioning of the entire surface.

Thus, while the first mentioned methods of treating the surface of some plastics do not deal with subsequent chemical metal coating and plating of plastics, this last mentioned conditioning method does not permit uniform plating of the conditioned plastic surface. And the initially described methods of conditioning the surfaces of plastics with the use of chromium trioxide containing solutions have a number of disadvantages and do not yield fully satisfactory metal deposits.

SUMMARY OF THE INVENTION

It is one object of the present invention to provide a simple and highly effective process of conditioning plastics and of providing the thus conditioned plastic surface with a uniform and well adhering metal layer, which process is applicable to any kind and type of plastic.

Another object of the present invention is to provide plastic articles which are coated with a metal layer of heretofore unknown adhesive strength and uniformity.

Other objects of the present invention and advantageous features thereof will become apparent as the description proceeds.

In principle the process according to the present invention comprises the following steps:

a. The plastic article is exposed to the action of an atmosphere containing sulfur trioxide. This conditioning step replaces the chemical pretreatment of steps (1) or (1*a*) of the hereinabove described known processes of conditioning plastics for subsequent metal plating by means of a chemical treatment with an aqueous solution of chromium trioxide and sulfuric acid or sulfuric acid and phosphoric acid. Steps (2) or (2*a*) of said known processes can then be omitted in the process of this invention.

Pretreatment in an atmosphere containing sulfur trioxide has the advantage that the duration of the treatment is reduced considerably, that only a single conditioning agent is used, and that the concentration of said conditioning agent may vary within wide limits. Thus all the difficulties of continuously supervising analytically the conditioning solution and regenerating the chromium trioxide conditioning solutions as well as the difficulties in removing the used conditioning solution are eliminated.

The pretreatment in an atmosphere containing sulfur trioxide according to the present invention has the further advantage that it can be applied to many more of the technically useful plastics then this is possible when using the known chromium trioxide containing conditioning solution. Thus the process of the present invention permits substantially more types of plastics to be provided with a firmly adhering metal layer.

The surface of the pretreated plastic material it changed only to an extent that it is possible, on subsequent metal coating, to provide a smooth and wall adhering metal layer when carrying out the pretreatment at an optimum predetermined sulfur trioxide concentration and conditioning time. Thereby, no macroscopically visible changes of the plastic surface due to abrasion or roughening take place. The initially hydrophobic surface of the plastic material is rendered wettable by water when conditioned according to the present invention.

The known processes of pretreating the surfaces of plastics which use sulfonating agents are not at all or only insufficiently suitable for pretreating plastics in order to subsequently provide them with metal layers which meet the requirements of the metal plating technique. Thus it is entirely unexpected that conditioning in a sulfur trioxide containing atmosphere according to the present invention renders the surface of a considerably greater number of plastics than the prior art especially suitable for nucleation or activation with noble metals and for subsequent metal coating according to known processes.

It is, of course, understood that the sulfur trioxide containing atmosphere as it is used for chemical conditioning of plastic materials is composed of a gas which does not enter into reaction with sulfur trioxide. Preferably this carrier gas is air. However, other gases may also be used for this purpose such as oxygen, nitrogen, carbon dioxide, noble gases, and other gases meeting the requirement of non-reactivity with sulfur trioxide. If the gas of the conditioning atmosphere contains water vapors, first sulfuric acid mist is formed with the sulfur trioxide until all the moisture has been bound. Only the excess of free sulfur trioxide gas present in the conditioning atmosphere will then be available for the desired treatment of the surface of the plastic material. It was found, however, that the sulfur acid mist formed by a moisture content of the carrier gas does not substantially affect the desired conditioning treatment.

The concentration of sulfur trioxide in the atmosphere serving for conditioning the surface of the plastic material, amounts, in general, between 1 mg./l of sulfur trioxide and up to 100%, by volume, of sulfur trioxide. The most useful conditioning time was found to be between about 0.5 seconds and about 20 minutes. Of course, the temperature of the conditioning atmosphere is also of importance for achieving satisfactory conditioning results. Good results are obtained at a gas temperature of −30° C. as well as at about 130° C. whereby, of course, the sulfur trioxide concentration and the duration of treatment must be adjusted with respect to each other.

Conditioning time, temperature, and sulfur trioxide concentration in the conditioning gas are dependent upon the type of plastic material to be treated. Thus, on the one hand, shorter conditioning times coupled with higher sulfur trioxide concentration or, respectively, higher temperatures of the conditioning atmosphere and, on the other hand, longer conditioning time coupled with a lower sulfur trioxide concentration or, respectively, a lower conditioning temperature will yield like results.

Of course, the concentration range of the sulfur trioxide, the conditioning temperature, and its duration must be selected in accordance with the different chemical structure and reactivity of the known plastics in such a manner that optimum conditioning of the plastic surface and complete coating with the metal precipitated chemically thereon as well as satisfactory adhesive strength of the final metal layer subsequently provided by chemical or electroplating are achieved. A further advantage of the process of the present invention is the fact that all these operating conditions result in excellent metal coatings on a wide variety of plastic types even within very wide limits.

The heretofore used chromic acid conditioning solution required types of plastics which were produced especially for such a treatment in order to achieve, for instance, with ABS plastics, with polypropylene, or the like a satisfactory metal coating of sufficient adhesive strength of the final metal layer. In contrast thereto, when conditioning plastics according to the present invention in an atmosphere containing sulfur trioxide, it is possible to successfully metal coat plastics of the above mentioned type which need not be produced specifically for such metal coating. In addition thereto, polyvinylchloride, polyethylene, polypropylene, polystyrene, phenolic resins, epoxy resins, and many others can be metal coated according to the present invention. After reenforcing the initial metal layer, it has in most instances an adhesive strength of more than 2 Kp for each 2.5 cm. Very frequently an adhesive strength of 5 Kp and even higher is achieved. In almost all instances the initial satisfactory adherence can be considerably increased by a heat treatment following the metal coating step.

The sulfur trioxide containing atmosphere required for conditioning plastics according to the present invention can be produced by different procedures. For instance, an inert gas such as air, nitrogen, carbon dioxide, or a noble gas is passed over sulfur trioxide heated to the required predetermined temperature whereby the vapor tension above the sulfur trioxide is in conformity with the temperature. The inert gas passing through the sulfur trioxide is then charged with an amount of sulfur trioxide which corresponds to the respective vapor tension. The vapor tension-temperature curves of sulfur trioxide are, of course, known.

Another way of producing a sulfur trioxide containing atmosphere consists in vaporizing sulfur trioxide by heating it to the required temperature and then introducing the sulfur trioxide vapor into a suitable gas volume enclosed in a container.

Instead of starting with pure sulfur trioxide, it is also possible to heat to the boiling point sulfuric acid which is saturated with sulfur trioxide and which is commercially available as oleum or fuming sulfuric acid containing about 65% of sulfur trioxide. The sulfur trioxide released thereby is then employed in accordance with the present invention.

A sulfur trioxide containing atmosphere of a predetermined concentration can be produced in an especially simple manner by introducing into a volume of an inert gas enclosed in a container a solution of sulfur trioxide in sulfuric acid and heating said solution to a predetermined temperature. Thereby, the vapor tension and, as a result thereof, the sulfur trioxide concentration in the gas space are predetermined by the concentration of the sulfur trioxide in the sulfuric acid and by the temperature to which said solution is heated.

Of course, the above mentioned methods of producing a sulfur trioxide containing atmosphere are not the only ones and the present invention is not limited to said methods.

After the treatment of the plastic material in an atmosphere containing sulfur trioxide, the conditioned plastic parts are rinsed and treated in noble metal solutions as heretofore done.

Activation and, if required, sensitization are effected by means of the heretofore used solutions. All known solutions for the chemical precipitation of copper, nickel, or other metals can be used for metal coating the conditioned plastic surfaces. In all instances a uniform continuous metal layer is deposited. Said layer has a surprisingly high adherence to the plastic surface also after it has been provided with the final plate.

BRIEF DESCRIPTION OF THE DRAWINGS

The attached drawings demonstrate the differences in the surface of a plastic material pretreated according to the known method with chromic acid-sulfuric acid and according to the method of the present invention.

In these drawings

Figure 1:
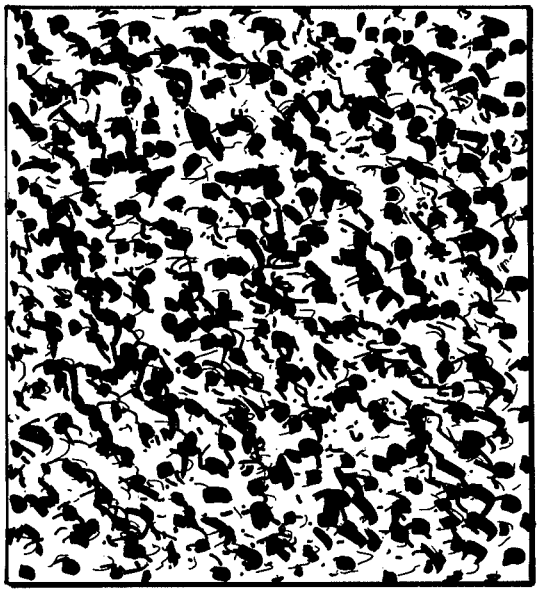
FIG. 1 PRIOR ART
FIG. 1 depicts the surface of an acrylonitrile-butadiene-styrene plastic after the conventional pretreatment with chromic acid and sulfuric acid at 60° C. for 12 minutes but before activation as shown under the scanning electron microscope. Enlargement: 10,000 times.

It is evident that the surface as shown in FIG. 1 is strongly pitted. That the metal layer adheres to the plastic surface is believed to be due to the metal being mechanically anchored in the indentations produced by the destruction by the chromic acid-sulfuric acid treatment of the butadiene component of the plastic which is present therein in the form of small globules.

In contrast thereto the surface of the same plastic material pretreated with sulfur trioxide oxide vapor according to the present invention shows an entirely different appearance. No pockets, cavities, or indentations are visible. Nevertheless, the adherence of the metal layer to the thus pretreated surface is at least as good as, and usually better than, that of the metal layer to the pretreated surface of FIG. 1.

Figure 2:
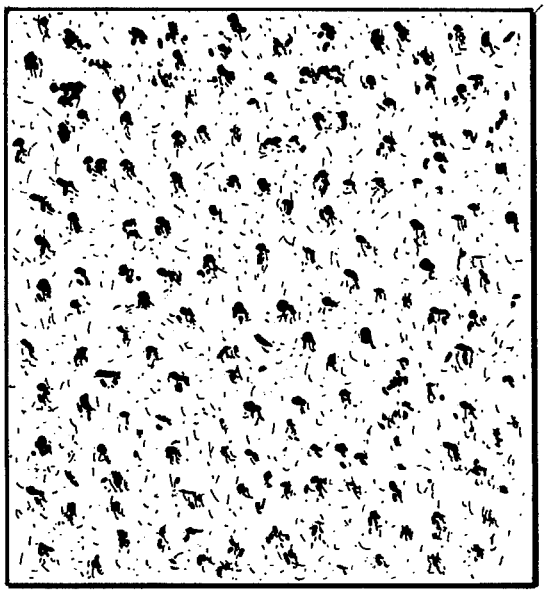
FIG. 2 depicts the surface of the same plastic when pretreated according to the present invention with sulfur trioxide vapor for 1½ minutes as described hereinafter in Example 8. Enlargement: 10,000 times.
Figure 3:
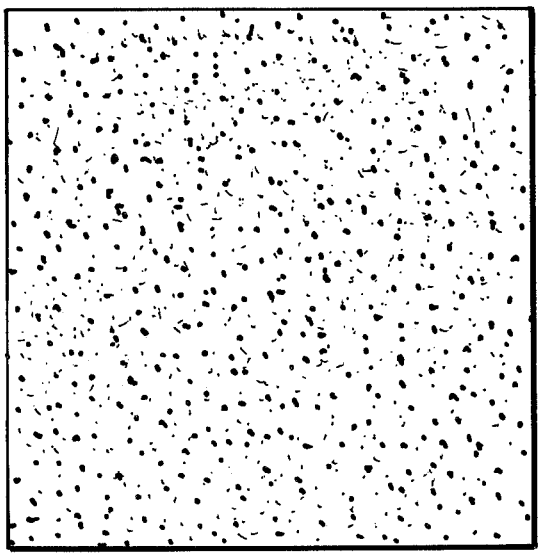
FIG. 3 depicts the surface of a high pressure polyethylene pretreated with sulfur trioxide vapor according to Example 12 given hereinafter.
Enlargement: 30,000 times.
Figure 4:
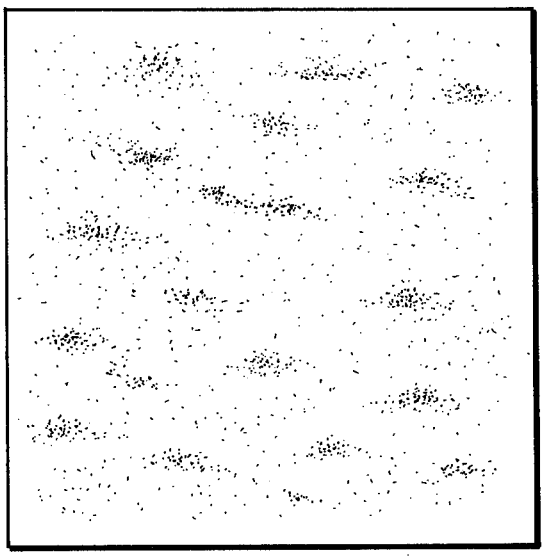
FIG. 4 depicts the surface of polystyrene pretreated with sulfur trioxide vapor according to Example 16 given hereinafter. Enlargement: 10,000 times.

Likewise, the surface of high pressure polyethylene as shown in FIG. 3 is also surprisingly smooth although it is of a finer structure than the surface of FIG. 2 due to the three times higher magnification.

The surface of polystyrene treated with sulfur trioxide vapor is even smoother than that of the plastics of FIGS. 2 and 3. In fact the surface is almost unchanged. Nevertheless excellent adherence of the metal layer thereto is achieved.

DESCRIPTION OF THE PREFERRED EMBODIMENTS

The following examples serve to illustrate the present invention without, however, limiting the same thereto. They indicate the manner and conditions in which the process of this invention can be applied for conditioning various types of plastics.

The following solutions are used in the examples given hereinafter:

a. Activation of the conditioned plastic surface:

Solution 1: 100 mg./l. of bivalent palladium Pd++ in the form of palladium nitrate or chloride: 20 ml./l. of concentrated sulfuric acid.

Solution 2: 100 mg./l. of bivalent palladium Pd++ in the form of palladium nitrate or chloride: 20 ml./l. of concentrated hydrochloric acid.

Solution 3: 5 g./l. of bivalent palladium Pd++ in the form of palladium nitrate, 20 ml./l. of concentrated sulfuric acid.

Solution 4: 1.5 g./l. of silver nitrate, 5 ml./l. of concentrated ammonia.

Time of immersion of the conditioned plastic into said solutions: One to two minutes at about 20° C.

b. Sensitization:

Solution 5: 20 g./l. of stannous chloride $SnCl_2$ 40 ml./l. of hydrochloric acid c. Reducing Solutions:

Solution 6: 1 g./l. of N-diethylamino borone. Its pH is adjusted to 9.0 by means of ammonia.

Solution 7: 50 cc./l. of formaldehyde.

d. Chemical Deposition of Metal:

Substantially all the solutions which are known for this purpose are suitable for chemical metal coating of the plastic surface conditioned according to the present invention. The following examples are mentioned:

Solution 8 for chemical nickel plating with hypophosphite:

22 g./l. of nickel sulfate, 20 g./l. of sodium hypophosphite, 20 g./l. of sodium acetate.

pH of the solution: 5.0

Temperature: 65° C.

Immersion time: 5 minutes to 10 minutes.

Solution 9 for chemical nickel plating with boron hydrides:

40 g./l. of nickel chloride crystalline,
20 g./l. of sodium acetate,
20 g./l. of sodium citrate,
0.2 g./l. of the sodium salt of methylene bisnaphthyl sulfonic acid,
2 g./l. of diethylamino borane.

pH of the solution: 5.5

Temperature: 60° C.

Immersion time: 5 to 10 minutes.

Solution 10 for chemical copper plating:

24 g./l. of crystalline copper sulfate,
110 g./l. of sodium potassium tartrate,
25 g./l. of sodium hydroxide,
60 ml./l. of formaldehyde 35%.

Temperature: 20° C.

Immersion time: 10 to 15 minutes.

The samples were thoroughly examined between each step of treatment i.e. conditioning and metal coating as mentioned in the following examples:

EXAMPLE 1

Small plates of ABS plastic of the type Novodur PM 2C manufactured by Farbenfabriken Bayer, Germany, are exposed at room temperature to the vapor phase above 65% oleum for one second. After activating the conditioned plates in Solution 1 and immersing them into Solution 6, they are chemically nickel plated in Solutions 8 or 9. The surface of the plastic plates is completely covered with a uniform and smooth nickel layer.

EXAMPLE 2

The same results are achieved by conditioning the plastic plates in the vapor phase 2a. over 23% oleum at room temperature for 5 minutes; or 2b. over 65% oleum at a gas temperature of −28° C. for 2 to 60 seconds; or 2c. in 100%, by volume, of sulfur trioxide at a gas temperature of 58° C. for half a second; or 2d. in 100%, by volume, of sulfur trioxide at a gas temperature of 72° C. for half a second.

EXAMPLE 3

Small plates of the same plastic material as used in Example 1 are conditioned in a nitrogen atmosphere containing sulfur trioxide in a concentration of 3 mg./l. for 3 minutes. After activation in Solution 1, immersion in Solution 6, and chemically nickel plating in Solutions 8 or 9 described in Example 1, the surface of the plastic plates is completely coated with a nickel deposit.

EXAMPLE 4

Conditioning is effected as described in Example 3 whereby, however, the sulfur trioxide concentration is 1 mg./l. Only about 60% to 70% of the surface of the plastic plates are coated with a nickel layer. When prolonging the exposure time to 15 minutes, complete coating of the plates with the nickel layer is achieved.

EXAMPLE 5

Small plates of the same plastic material as used in Example 1 are conditioned by exposure to sulfur trioxide in a carbon dioxide atmosphere over 30% oleum at room temperature for 2 minutes. The conditioned plates are then treated as described in Example 1. The surface of the plastic plates is completely covered with a uniform and smooth nickel layer.

EXAMPLE 6

Plates of the same plastic material as used in Example 1 are exposed to the sulfur trioxide vapor phase over 30% oleum at room temperature for 20 minutes. Activation and chemical nickel plating are then effected as described in Example 1. The plastic plates are completely coated with nickel. The surface of the plates shows a slight roughness because the conditioning treatment was unnecessarily prolonged.

EXAMPLE 7

Small plates of the following ABS plastic types designated by the trademarks 7a. Novodur PM 2C manufactured by Farbenfabriken Bayer, 7b. Novodur PM 20 manufactured by Farbenfabriken Bayer, 7c. Cycolac EP 3510 manufactured by Marbon Chemical, 7d. Terluran 876 O (Galvano type) manufactured by Badische Anilin und Soda-Fabrik (BASF), 7e. Terluran 877 T manufactured by BASF,
are kept in the atmosphere above 30% oleum at room temperature for two minutes. The thus conditioned plates are activated and chemically nickel plated as described in Example 1. Although different types of ABS plastics produced by different manufacturers are treated and although the type Terluran 877 T is considered unsuitable for metal plating, all plates are completely covered with a uniform smooth and bright nickel layer.

EXAMPLE 8

Small plates of the ABS plastic Type Novodur PM 2C are exposed to the atmosphere above 30% oleum at room temperature for different periods of time between 20 seconds and 20 minutes and are then activated as described in Example 1. Thereafter, a copper layer of 30 μm. thickness is electro-deposited upon the plastic plates. The adhesive strength of the layers is about the same with all plates and amounts to about 2.8 to 3.3 kp./2.5 cm.

EXAMPLE 9

Small plates of the ABS plastic Type Novodur PM 2C are exposed to the vapor phase above 30% oleum at room temperature for 2 minutes. After rinsing the plates in water, they are sensitized in Solution 5 and are activated in Solution 2 or 4. Electroless metal deposition is effected partly in an electroless copper bath and partly in an electroless nickel bath. The surfaces of the plastic plates are completely covered with a smooth copper or, respectively, nickel deposit.

EXAMPLE 10

Small plates of the ABS plastic Type Novodur PM 2C are exposed to the vapor phase above 30% oleum at room temperature for 2 minutes. The thus conditioned plates are activated in Solution 4, are then immersed into the reducing Solution 7 and are chemically copper plated. The plates are completely covered with a smooth copper deposit.

EXAMPLE 11

A high pressure polyethylene sheet is exposed to the vapor phase above 65% oleum at room temperature for 15 seconds. It is then activated in Solution 1, immersed in solution 6, and chemically nickel plated. The nickel layer is reinforced with a copper layer of 30 μm. thickness by electroplating. The adhesive strength of the copper layer is determined. The resulting values exceed a value of 5 kp./2.5 cm. two days after electroplating.

EXAMPLE 12

A high pressure polyethylene sheet is conditioned and copper plated as described in Example 11, whereby, however, the exposure time in the vapor phase above 65% oleum is increased to 30 seconds. The values for the adhesive strength are at about 2 kp./2.5 cm. After subsequent heat treatment of the sheets at 60° C. for 2 hours, the adhesive strength increases to more than 5 kp./2.5 cm.

EXAMPLE 13

A high pressure polyethylene sheet is conditioned as described in Example 11, whereby, however, the oleum concentration is 30% and the plastic is exposed to the sulfur trioxide vapor phase above such 30% oleum for 3 to 5 minutes. After chemically nickel plating the thus conditioned sheet and providing it by electroplating with a copper layer of 30 μm. thickness, the adhesive strength of the metal layer is between 3 kp./2.5 cm. and 5 kp./2.5 cm.

EXAMPLE 14

Small plates of hard polyvinylchloride are conditioned by exposure to the sulfur trioxide vapor phase above 65% oleum at room temperature for 15 to 30 seconds. The thus conditional plates are activated in Solution 1, immersed into Solution 6, and chemically nickel plated. The adhesive strength of the copper deposit provided by electroplating and having a thickness of 30 μm. is between 4 kp/2.5 cm. and 5 kp./2.5 cm.

EXAMPLE 15

Small plates of impact resistant polyvinylchloride are exposed to the sulfur trioxide vapor phase above 65% oleum at room temperature for one minute. The thus conditioned plates are then treated as described in Example 14. The adhesive strength exceeds 5 kp./2.5 cm.

EXAMPLE 16

Small plates of polystyrene are exposed to the sulfur trioxide vapor phase above 50% oleum at room temperature for two minutes. The thus conditioned plates are then treated as described in Example 14 without subsequent copper plating. The plastic surface is chemically nickel plated and is completely covered with a smooth nickel layer.

EXAMPLE 17

Small plates of a styrene-acrylonitrile copolymerization product are exposed to the sulfur trioxide vapor phase above 50% oleum at room temperature for one minute. The thus conditioned plates are then treated as described in Example 14. The adhesive strength of the copper deposit amounts to 1.6 kp./2.5 cm., and can be increased by a heat treatment at 70° C. to 3.5 kp./2.5 cm.

EXAMPLE 18

Small plates of polycarbonate plastic are exposed to the sulfur trioxide vapor phase above 65% oleum at room temperature for various periods of time between 30 seconds and 5 minutes. After activation in Solution 1, immersion in Solution 5, and chemically nickel plating the thus conditioned plates, their surfaces are uniformly coated with a nickel deposit.

EXAMPLE 19

Paper plates of epoxy resin as they are used for making printed circuits are exposed to the sulfur trioxide vapor phase above 23% oleum at room temperature for various periods of time between 30 seconds and 5 minutes. The thus conditioned plates are then copper plated as described in Example 11. The adhesive strength of the resulting metal layer exceeds 5 kp./2.5 cm.

EXAMPLE 20

Plates of epoxy resin reinforced by glass fibers as they are commonly employed for printed circuits are exposed to the sulfur trioxide vapor phase above 65% oleum at room temperature for various periods of time between 5 seconds and 5 minutes. The thus conditioned plates are activated in Solution 3, briefly immersed into Solution 6, chemically nickel plated, and finally provided by electroplating with a copper plate of 30 μm. thickness. The adhesive strength of the metal layer determined immediately after electroplating, increases with increasing conditioning time in the sulfur trioxide atmosphere from 2.5 kp./2.5 cm. to 4.5 kp./2.5 cm. If after copper plating the plates are heated to 100° C. for one hour, the adhesive strength of all plates exceeds 5 kp./2.5 cm.

EXAMPLE 21

Paper plates of phenol-formaldehyde resins for printed circuits are exposed to the sulfur trioxide vapor phase above 12% oleum at room temperature for periods of time between 5 seconds and 60 seconds. The thus conditioned resin plates are activated in Solution 1, subsequently immersed into Solution 6, and then chemically nickel plated. All the plates are provided with a smooth nickel deposit completely covering the plates. A copper layer of 30 μm. thickness which is deposited thereon by electroplating, has an adhesive strength of 1.5 kp. to 1.8 kp./2.5 cm. When rinsing the plates with water after the treatment according to the present invention and drying the rinsed plates at 80° C. for about 30 minutes, the adhesive strength amounts to 2.4 kp./2.5 cm. to 2.6 kp./2.5 cm.

EXAMPLE 22

Phenol-formaldehyde resin plates for printed circuits which are provided with a layer of an adhering lacquer commonly used for the additive manufacture of conductive plates are exposed to the sulfur trioxide vapor phase above 50% oleum at room temperature for periods of time between 30 seconds and 5 minutes. The thus conditioned plates are then treated as described in Example 1. A copper layer additionally deposited thereon and having a thickness of 30 μm. has an adhesive strength exceeding 5 kp./2.5 cm.

EXAMPLE 23

A soft rubber plate of the commercial quality "steam rubber" is exposed to the sulfur trioxide vapor phase above 65% oleum at room temperature for periods of time between 5 seconds and 60 seconds. The thus conditioned rubber plates are activated in Solution 3 for 5 minutes, are then treated in Solution 6 for one minute, and are chemically nickel plated in Solution 8 described hereinabove, for 5 minutes. Thereafter the metal layer is reenforced by electroplating with a copper deposit of 30 μm. thickness. Immediately after electroplating adhesive strength values between 2.5 kp./2.5 cm. and 3.5 kp./2.5 cm. are determined depending upon the conditioning time. When heating the plates after copper plating to 80° C. for two hours, the adherence of the copper layer to the plate is such that the metal layer does not separate from the rubber plate but that the rubber plate itself becomes torn.

EXAMPLE 24

Plates of ABS plastic, type Novodur PM 2C, are treated at room temperature in the sulfur trioxide containing vapor phase above 22% oleum for 30 seconds whereafter the thus conditioned plates are nickel plated as described in Example 1. The surface of the plates is covered with the nickel deposit to about 80% only. Prolonging the exposure time to three minutes results in completely coating the surface with the nickel layer.

Of course, other plastic materials and articles than those mentioned in the preceding examples can be used for conditioning and electroplating according to the present invention. As stated above, any type of plastic material can be metal plated when first conditioning the plastic surface by exposing it to sulfur trioxide vapors, while heretofore only specifically manufactured ABS-plastics could be metal plated. The specific conditioning conditions such as optimum or preferred temperature, duration, concentration of the sulfur trioxide in the sulfur trioxide containing atmosphere can readily be determined for each type of plastic material by simple preliminary tests. The following Table, for instance, shows a test series for determining the preferred conditioning duration and sulfur trioxide concentration in the oleum supplying the sulfur trioxide containing atmosphere at room temperature for high pressure polyethylene. Thereby the conditioned polyethylene was activated in Solution 1, immersed into Solution 6, chemically nickel plated, and electroplated with copper to a thickness of the metal layer of 30 μm. In said Table there are indicated:

a. The time during which the high pressure polyethylene was exposed to the sulfur trioxide containing atmosphere.

b. The sulfur trioxide content of the oleum yielding sulfur trioxide in the vapor phase above the oleum.

c. The appearance of the plastic samples, i.e. to what extent their surface was covered with the metal layer.

d. The adhesive strength of the metal layer determined according to the DIN 40802 Sheet 1 test method (Section 4.5 and especially 4.5.2.1. and 4.5.2.2.). The adhesive strength is given in kp./25 mm.

TABLE

| Conditioning Duration | $SO_3$-Concentration in oleum | Appearance of Samples | Adhesive strength in kp./2.5 cm. |
|---|---|---|---|
| 15 seconds | 65 % | completely metal plated | 5 |
| 30 seconds | 65 % | completely metal plated | 5 |
| 1 minute | 65 % | completely metal plated | 1.0–1.75 |
| 3 minutes | 65 % | completely metal plated | 0.4–0.6 |
| 15 seconds | 30 % | partly metal plated | — |
| 30 seconds | 30 % | partly metal plated | — |
| 1 minute | 30 % | partly metal plated | — |
| 3–5 minutes | 30 % | completely metal plated | 3–5 |

Thus it is evident from these preliminary tests that, with 65% oleum the conditioning time should be between 15 seconds and 30 seconds because with a more prolonged conditioning time the adhesive strength of the metal coating is too low and unsatisfactory although the surface of the polyethylene is completely metal plated. On the other hand when exposing the polyethylene to the sulfur trioxide vapor phase above a 30% oleum, the conditioning time must be at least three minutes since with an exposure time of one minute and less the surface of the plastic is not completely metal plated.

It is evident that optimum conditioning time and temperature as well as sulfur trioxide concentration can readily be predetermined in this manner by examining the metal plated plastic, if necessary, under the microscope for the completeness of the metal coating and by determining the adhesive strength of a metal coating of 30 μm. thickness which should at least be 2.0 kp./2.5 cm. when tested according to the DIN 40802 Sheet 1 test method.

As stated above, no metal plated plastic of such an adhesive strength has been produced heretofore except when using as carrier the ABS plastics of the Galvano type and a polypropylene type which are specifically manufactured for metal plating. All the other plastics and also other ABS types cannot be metal plated satisfactorily with an adhesive strength of at least 2.0 kp./25 mm. by the heretofore used chromic acid-sulfuric acid conditioning treatment.

As shown in Examples 12, 17, 20, 21, and 23, subsequent heat treatment of the metal plated plastic is effected, for instance, by placing the plastic in a dryer and keeping the temperature in said dryer at the value given in said examples. Of course, other methods of heat treating the metal plated plastics can also be employed. Such heat treatment usually improves the adhesive strength considerably.

Rinsing of the conditioned plastic material is effected by means of tap water. No specific precautions need be observed thereby.

As stated above, for sensitizing, activating, and, if required, reducing the sulfur trioxide vapor-conditioned plastic there can be employed all the heretofore used sensitizing, activating, and reducing solutions as they are known to the art, such as the Solutions 1 to 4 illustrating activation by palladium, silver, or other noble metals, Solution 5 illustrating a sensitizing stannous chloride solution, Solutions 6 and 7 illustrating suitable reducing solutions.

There is first provided a thin metal layer on the thus conditioned plastic surface, usually by chemical metal deposition. The thickness of said layer is in general between about 0.2 μm. and about 1.0 μm. Metal layers of such a thickness are sufficiently conductive so that subsequent reenforcing of the metal layer by electroplating to the desired thickness can be carried out without difficulty. It is, of course, also possible to reenforce the initially deposited metal layer by chemical deposition of the metal. However, such a mode of metal plating requires very considerably more time than electroplating. For instance, while electroplating the conditioned plastic with a copper or nickel layer of 20 μm. thickness requires between about 20 minutes and about 45 minutes depending on the electrolyte employed, chemical deposition of a copper or nickel layer of the same thickness cannot be effected within less than 10 hours and often requires up to 20 hours. Furthermore, the metal layers produced by electroplating have the advantage that they are ductile and very flexible while thick, chemically deposited metal layers are rather brittle.

Electroplating is performed in a manner known per se by placing or suspending the pre-metal plated plastic material or article as the cathode into an electrolyte as it is conventionally used for depositing the desired metal. A compact piece of the metal to be deposited is used as the anode and the electrodes are connected with a source of direct current. The current density (Amp./sq.dm.) at the kathode is adjusted by varying the potential of the cell in such a manner that it corresponds to the optimum working conditions of the respective electrolyte. These optimum working conditions of various electrolytes are well known and are given in the directions for use of the respective suppliers of the electrolytes. For instance, the following books and articles describe such electroplating methods more in detail. They are included by reference into the present specification:

Kirk-Othmer "Encyclopedia of Chemical Thechnology", 2nd edition, volume 8, pp. 36–74, chapter "Electroplating", Interscience Publishers, New York 1965 and the literature cited therein.

R.W. Furness "The Practice of Plating of Plastics", Robert Dryer Ltd., Teddington 1968.

H. Wiegand "Metallische Ueberzuege auf Kunststoffen", Carl Hanser Verlag, Muenchen 1966.

I.W. Rose "Electroplating of plastics mouldings" in "Electroplating and Metal Finishing", pp. 24–32, August 1970.

R.R. Smith et al. "Further Developments in Plastics for Electroplating" in "Electroplating and Metal Finishing", pp. 44–47, February 1968.

E.B. Saubestre "Plating of Plastics: Current Status of Processes and Standards" in "Transactions of Institute of Metal Finishing", vol. 47, pp. 228–234 (1969).

K. Heymann et al. "Electroplating of Plastics in Theory and Practice" in "Angewandte Chemie-International Edition", vol. 9, No. 6, pp. 425–433, 1970.

By properly regulating the duration of the electrolysis it is possible to deposit the desired metal layer upon the plastic material or article, thereby taking into account the current density employed and the equivalent of deposition of the metal to be deposited (Coulomb/g.-mole). Usually copper layers are deposited from acid copper sulfate or copper fluoroborate electrolytes. Nickel layers can also be deposited from any of the well known nickel electrolytes. It is also possible to directly deposit by electroplating tin, zinc, silver, gold, cadmium, and other metal layers by using electrolytes as they are conventionally used for electroplating.

As stated hereinabove, any type of plastic material may be used for the conditioning and electroplating process of the present invention. Thus, for instance, the high pressure polyethylene of Examples 11 to 13 is a polyethylene sold by Badische Anilin- und Soda-Fabrik under the trademark "Lupolen", the impact resistant polyvinylchloride of Example 14 is supplied by Dynamit Nobel under the trademark "Trovidur HS 15", the styreneacrylonitrile plastic of Example 17 is the "Luran" type plastic of Badische Anilin- und Soda-Fabrik, the polycarbonate of Example 18 is the "Makrolon" type of Farbenfabriken Bayer, the epoxy resin paper of Example 19 is the "Type Hp 5302" of Dynamit Nobel, the glass fiber reenforced epoxy resin of Example 20 is the "Type EGS 102/G 10" of Ferrozell, and the phenol resin paper of Example 21 the "Type Hp 2063" of Ferrozell. Other plastics which can be conditioned for metal plating according to the present invention are, for instance, homopolymers and copolymers of ethylenically unsaturated aliphatic, alicyclic, and aromatic hydrocarbons, such as polybutylene, polyisobutylene, copolymers of ethylene and propylene as well as of ethylene, propylene, and other olefinic hydrocarbons, polybutadiene, polyisoprene of natural or synthetic origin, polymers of pentene, hexene, heptene, octene, 2-methyl propene, 4-methyl hexene-(1), bicyclo-(2,2,1)-heptene-(2), pentadiene, hexadiene, 2,3-dimethyl butadiene, vinyl cyclohexene, cyclopentadiene, methyl styrene, and other olefinic hydrocarbons, polyindene, indene-coumarone resins, acrylic acid esters and methacrylic acid esters, cellulose derivatives, such as cellulose acetate, cellulose acetate butyrate, cellulose nitrate, ethyl cellulose, hydroxy ethyl cellulose, methyl cellulose, carboxy methyl cellulose and its sodium salts, furane resins, isocyanate resins such as polyurethanes, urea-formaldehyde resins, melamine-formaldehyde resins, melamine-urea-formaldehyde condensation products, polyamides, polyamide-epoxy resins, polyester resins, resorcinol-formaldehyde resins, resorcinol-furfurol resins, chlorinated rubber, polysulfides, vinyl resins such as polyvinyl acetate, copolymers of vinyl acetate and vinyl alcohol, copolymers of vinyl acetate and vinyl chloride, polyvinyl alcohol, polyvinyl butyral, polyoxymethylene, polyphenylene oxide, polycarbonates, copolymers of bisphenols and epichlorohydrin, polysulfones, polyacetals, and in fact any other film-forming or moldable natural or synthetic resin.

Such plastics may contain filler materials such as glass fibers, asbestos, or other mineral fillers, sawdust, carbonaceous materials such as graphite, dyestuffs, pigments, and others.

The plastic carrier for the metal layer may be of different shape such as in the form of films, foils, molded articles, rods, fibers, woven textile material, or the like.

We claim:

1. In a process for metal plating a natural or synthetic resinous material, including the steps of:

a. conditioning the surface of the natural or synthetic resinous material;

b. activating the conditioned surface by providing a noble metal thereon; and c. depositing a metal coating upon the activated surface from an electroless plating bath, wherein the improvement comprises said conditioning step consisting essentially of exposing the natural or synthetic resinous material to the action of a gaseous sulfur trioxide-containing atmosphere containing between about 1 mg/l and 100%, by volume, of sulfur trioxide for a period of time between about 0.5 seconds and 20 minutes sufficient to condition the surface of the material without substantially physically affecting the material.

2. The process as defined by claim 1, wherein said step of activating the surface of the natural or synthetic resinous material comprises immersing said material into a solution containing a nobel metal ion, and subsequently immersing said material into a solution containing a reducing agent for the noble metal ion.

3. The process as defined by claim 1, wherein said step of activating the surface of the natural or synthetic resinous material comprises sensitizing the surface by immersing the article into an acidified solution of stannous chloride, and subsequently immersing said material into a solution containing a noble metal ion.

4. The process as defined by claim 1, further comprising the step of reinforcing the metal layer deposited from said electroless plating bath by depositing additional metal plating on said material electrolytically.

5. The process as defined by claim 1, wherein said noble metal is selected from the group consisting of palladium, silver and gold.

6. The process as defined by claim 2, wherein said reducing agent is selected from the group consisting of N-diethylamino borazane and formaldehyde.

7. The process as defined by claim 1, wherein said electroless plating bath is a copper plating bath or a nickel plating bath.

8. The process as defined by claim 1, wherein the sulfur trioxide containing atmospheres contains at least 10 mg./l of sulfur trioxide.

9. The process as defined by claim 1, wherein the sulfur trioxide containing atmosphere comprises the vapor phase over oleum of a concentration up to 65% sulfur trioxide.

10. The process as defined by claim 1, wherein said conditioning step is carried out at a gaseous atmosphere temperature at which the natural or synthetic resinous material is thermally stable.

11. The process as defined by claim 10, wherein said temperature is between about −30° C. and 130° C.

12. The process as defined by claim 2, wherein said temperature is approximately room temperature.

13. The process as defined by claim 4, wherein said natural or synthetic resinous material is exposed to the gaseous sulfur trioxide-containing atmosphere for a period of time sufficient to provide a bonding strength to said surface of at least about 2 kp./2.5 cm. for a 30 μm layer of deposited metal when tested according to DIN 40802 Sheet 1 method.

14. The process as defined by claim 1, wherein said gaseous sulfur trioxide-containing atmosphere comprises sulfur trioxide and a gas inert to and unreactive with sulfur trioxide.

15. The process as defined by claim 14, wherein said inert gas is selected from the group consisting of air, nitrogen, carbon dioxide and a noble gas.

16. The process as defined by claim 1, wherein said natural or synthetic resinous material is selected from the group consisting of polyethylene, polypropylene, polyvinylchloride, polystyrene, the copolymerization product of styrene and acrylonitrile, the copolymerization product of acrylonitrile, styrene and butadiene, a phenol-formaldehyde condensation product, an epoxy resin, an elastomer, a polysulfone, a polycarbonate, a polyamide, a polyacetal, a polyphenylene oxide, a urea-formaldehyde-condensation product, a melamine-formaldehyde condensation product, a polyester resin, acrylic acid ester polymers, and polyvinylacetate.

17. The process as defined by claim 1, wherein said natural or synthetic resinous material comprises paper impregnated with a phenol-formaldehyde condensation product.

18. The process as defined by claim 1, wherein said natural or synthetic resinous material comprises a plate for printed circuits provided with an adhesive lacquer.

19. The process as defined by claim 1, wherein said natural or synthetic resinous material comprises said material containing a filler material.

20. The process as defined by claim 19, wherein said filler is selected from the group consisting of glass fibers and cellulose fibers.

21. The process as defined by claim 1, wherein said natural or synthetic or synthetic resinous material comprises rubber.

22. The process as defined by claim 1, wherein said step of metal coating said article in an electroless coating bath is carried out to provide a metal layer having a thickness between about 0.2 and 1 micron.

23. The process as defined by claim 4, wherein said step of electrolytically depositing a metal coating upon said material is carried out to provide a metal coating of up to about 30 microns.

24. The process as defined by claim 4, further comprising the step of heat treating the metal coated material by exposing said material to an elevated temperature.

25. A metal plated article of natural or synthetic resinous material, comprising a substrate of said natural or synthetic resinous material, said substrate having a surface which is macroscopically smooth, a layer of metal deposited upon said surface, said layer of metal being bonded to said surface by a strength of at least about 2 kp/2.5 cm., said metal plated article having been produced in accordance with the process defined by claim 1.

26. A metal plated article of a natural or synthetic resinous material, comprising a substrate of said natural or synthetic resinous material, said substrate having a surface which is macroscopically smooth, and a metal layer deposited upon said surface, said metal layer being bonded to said surface by strength of at least about 5 kp/2.5 cm., said article having been produced according to the process defined by claim 24.

27. The metal plated article as defined by claim 25, wherein said material is an acrylonitrile-butadiene-styrene copolymer and said bonding strength is between about 2.8 and 3.2 kp/2.5 cm.

28. The metal plated article as defined by claim 25, wherein said material is polyvinylchloride and said bonding strength is greater than about 5 kp/2.5 cm.

29. The metal plated article as defined by claim 26, wherein said material is a styrene-acrylonitrile copolymer, and said adhesive bonding strength is about 3.5 kp/2.5 cm.

30. The metal plated article as defined by claim 25, wherein said material is polypropylene.

31. The metal plated article as defined by claim 25, wherein said material is polyethylene.

32. The process as defined by claim 1, wherein said natural or synthetic resinous material is selected from the group consisting of polypropylene, polyvinylchloride, polystyrene, the copolymerization product of styrene and acrylonitrile, the copolymerization product of acrylonitrile, styrene and butadiene, a phenol-formaldehyde condensation product, an epoxy resin, an elastomer, a polysulfone, a polycarbonate, a polyamide, a polyacetal, a polyphenylene oxide, a urea-formaldehyde-condensation product, a melamine-formaldehyde condensation product, a polyester resin, acrylic acid ester polymers, and polyvinylacetate.

33. The process as defined by claim 1, wherein said natural or synthetic resinous material is an ABS polymer.

34. The process as defined by claim 1, wherein said natural or synthetic resinous material is polyvinyl chloride.

35. The process as defined by claim 1, wherein said natural or synthetic resinous material is polypropylene.

36. The process as defined by claim 1, wherein said natural or synthetic resinous material is polystyrene.

37. The process as defined by claim 1, wherein said natural or synthetic resinous material is polyethylene.

* * * * *